United States Patent [19]

Wolfert

[11] Patent Number: 4,554,862

[45] Date of Patent: Nov. 26, 1985

[54] ROOF RIDGE VENTILATOR FOR RETARDING MICROBE GROWTH IN SHINGLE ROOFS

[75] Inventor: Clarke K. Wolfert, Peoria, Ill.

[73] Assignee: Air Vent Inc., Peoria, Ill.

[21] Appl. No.: 623,092

[22] Filed: Jun. 21, 1984

[51] Int. Cl.[4] ..... F24F 7/02

[52] U.S. Cl. ..... 98/42.21; 52/517; 52/556

[58] Field of Search ..... 98/42 R, 42 A; 52/515, 52/516, 517, 556

[56] References Cited

U.S. PATENT DOCUMENTS

| | | | |
|---|---|---|---|
| 1,701,926 | 2/1929 | Kirschbraun | 52/556 X |
| 3,479,130 | 11/1969 | Rapaport | 52/517 X |
| 3,481,263 | 12/1969 | Belden | 98/42 A |
| 3,494,727 | 2/1970 | Rapaport | 52/517 |
| 4,276,732 | 7/1981 | Nielsen | 52/517 |
| 4,325,290 | 4/1982 | Wolfert | 98/42 A |

*Primary Examiner*—Harold Joyce

*Attorney, Agent, or Firm*—Silverman, Cass & Singer, Ltd.

[57] ABSTRACT

A roof ridge ventilator for the roof of a building having a shingled roof. The ventilator is formed substantially of zinc metal and has a longitudinally extending series of closely spaced drain hole punchings in the baffles thereof which are constructed and arranged to achieve flow of a substantially uniform sheet of a biostatic ionic solution of zinc across the shingled roof from opposite sides of the ventilator during rain, dew or melting snow conditions. Such a washing of the shingles prevents and retards fungus and bacterial growth which defaces the shingles.

4 Claims, 3 Drawing Figures

FIG. 1
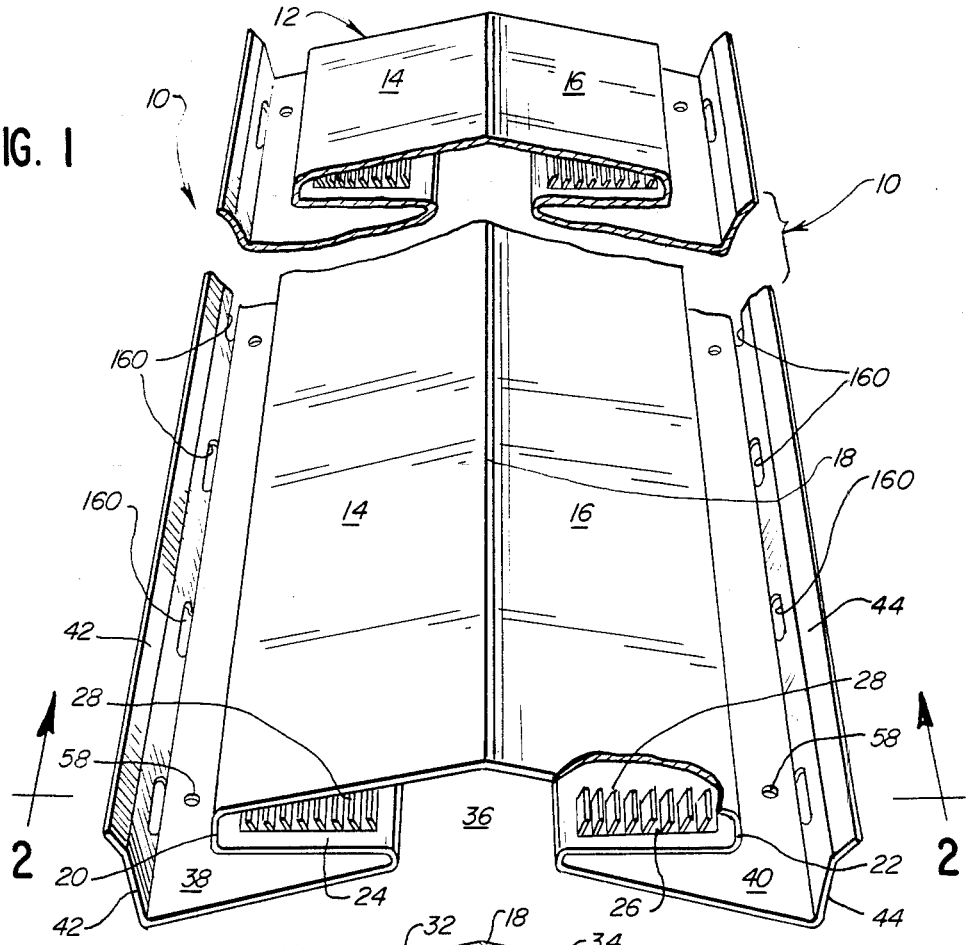
FIG. 2
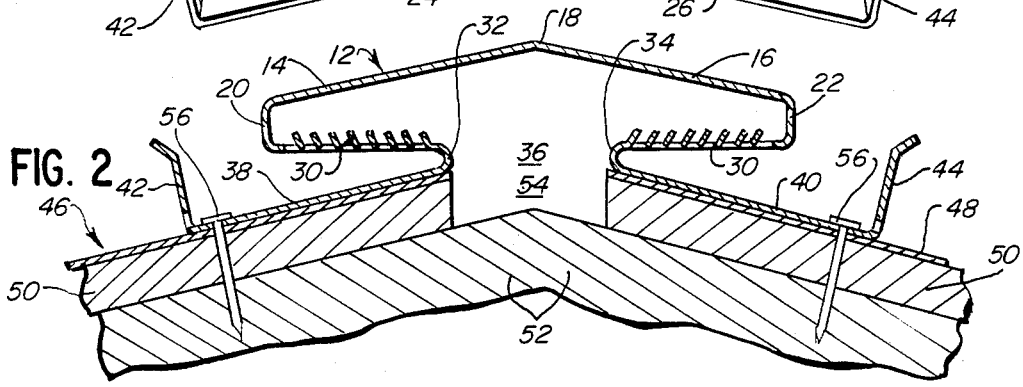
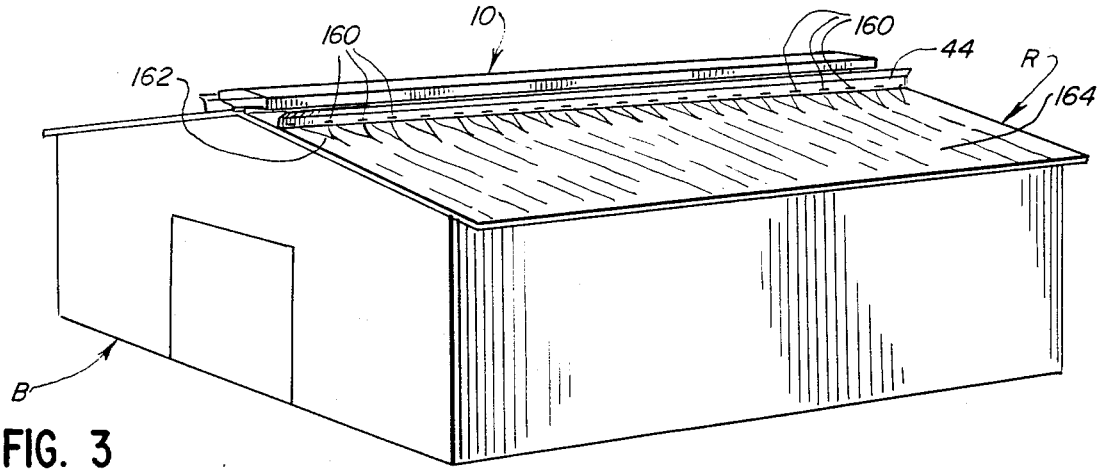
FIG. 3

ROOF RIDGE VENTILATOR FOR RETARDING MICROBE GROWTH IN SHINGLE ROOFS

BACKGROUND OF THE INVENTION

In many tropical and sub-tropical climates, it is quite common to see roof discoloration resulting from fungus or bacterial growth. This condition is addressed, for instance, in U.S. Pat. No. 3,494,727 and proposed to be solved by doping roof shingles with chips of metallic elements, the ions of which are capable of producing microbiological effects on microbes contacting the roof shingles. One of the metals mentioned for this purpose was zinc. See also U.S. Pat. No. 3,527,596 teaching the use of zinc granules.

In U.S. Pat. No. 3,479,130, the problem of retarding microbe growth in shingled roofs is confronted with the use of bimetallic strips capable of acting like an electrocouple, at least one of the metals selected being zinc.

Roof ridge ventilators, such as taught in my U.S. Pat. No. 4,325,290, are recognized as valuable and useful roof installations for achieving desirable ventilation of the space below the roof of the building. Such ridge ventilators usually are formed of aluminum or like structural metal which can be formed to the necessary shapes for the ventilator. Insofar as I am aware, such roof ventilators have never been formed of rolled sheet zinc material.

The ventilator of my patent has baffles 42 and 44 on opposite longitudinal sides thereof. The apertures 60, commonly known as weep holes, are provided in the baffles 42 and 44 at spaced distances one from the other along the length of the ventilator 10 to provide for moisture to drain from the ventilator 10 downwardly across the roof. However, it should be noted that the individual weep holes 60 are quite elongated and quite spaced apart. Thus, the liquid flow from this arrangement of holes 60 is intermittent and not sheet-like across the roof. Darkening and discoloration of shingled roofs because of fungus growth also occurs.

SUMMARY OF THE INVENTION

A roof ridge ventilator is formed of rolled sheet zinc to include a pair of baffles along opposite longitudinal sides of the ventilator. Each baffle has a series of closedly spaced, moderately sized drain openings or weep holes extending the length of the ventilator. As rain, dew or snow drains through these weep holes, a biostatic ionic solution of zinc is caused to wash downwardly across the shingled roof from opposite sides of the ventilator in a substantially uniform liquid sheet. Microbal and fungus growth on the shingled roof is prevented.

DESCRIPTION OF DRAWINGS

FIG. 1 is a fragmentary top perspective view of the roof ridge ventilator embodying the invention.

FIG. 2 is a sectional view taken through the ventilator along the line 2—2 and in the direction indicated generally.

FIG. 3 is a perspective view, somewhat diagrammatical in nature, showing the said roof ridge ventilator installed on the roof of a building and the sheet-like liquid flow achieved across the roof by means of the selectively spaced and dimensioned weep holes.

DESCRIPTION OF PREFERRED EMBODIMENT

Referring to FIG. 1, the roof ridge ventilator embodying the invention is designated generally by the reference character 10. It is an integral, elongate sheet member to have essentially mirror image left and right halves. For purposes of describing the invention without unnecessary detail, it will be noted that the ridge ventilator 10 is substantially identical to the ridge ventilator 10 of my U.S. Pat. No. 4,325,290 in configuration and size with the exception of the sheet metal material from which they are formed and the size and spacing of the weep holes thereof.

I hereby incorporate into this application the specification of my U.S. Pat. No. 4,325,290 and will assign the same numerical designations used in said patent for identical or corresponding parts of the ventilator 10 hereof. This will eliminate the need for repeating the disclosure except for the salient parts of ventilator 10 which focus on the invention hereof.

The ventilator 10 of FIG. 1 is formed of rolled zinc sheeting formed to shape by known techniques. Attention is directed to the drain or weep holes 160 formed in each baffle 42 and 44. The holes 160 extend the entire length of a baffle or ventilator and are quite closely spaced from adjacent holes. Thus, a straight line of holes 160 is achieved in each baffle, with each hole being shorter than the hole 60 of my patent. Each hole 160 is located in the juncture of the baffle with its contiguous flashing part 38 or 40, as the case may be. The number of holes 160 is at least double the number of the holes 60 of my patent.

The filter material of my patent is not necessary for purposes of this invention.

Referring to FIG. 3, the roof ridge ventilator 10 is shown installed on a building B having a roof R which would be shingled or otherwise covered with a shingle-like material of conventional formulation. Liquid 162 is shown streaming from the weep holes 160 to form a substantial sheet 164 of liquid draining from the ventilator 10 downwardly across roof R. This liquid sheet 164 will consist of zinc ions in solution and will provide the desired retardation of microbe or fungus growth uniformly over the roof R over which the solution passes. This uniform sheet of liquid flow prevents unsightly streaking which would be caused when portions of a roof are not treated with these solutions.

Looking carefully at FIG. 4, it will be seen that as moisture passes outwardly from the hole 160, it spreads or bubbles outwardly. The moisture from adjacent openings commingles to form a layer or moisture, thereby increasing the surface area of the roof over which it washes or comes in contact. This phenomenon contributes to formation of a sheet of liquid 164 which will pass downwardly over the shingled roof on opposite sides of the ventilator. This diffusion of zinc ion impregnated liquid is substantially uniform and consistent so that streaking is avoided.

Tests were conducted of a preferred embodiment of an installed ridge ventilator 10 in which each weep hole 160 was approximately $\frac{3}{4}$ inches long and $\frac{1}{4}$ inches wide and the weep holes were arranged on 3 inch centers. The distance between adjacent weep hole 160 was approximately $2\frac{1}{4}$ inches. Moisture was expressed through the weep holes 160 at an estimated rate of normalcy to note that the single sheet of liquid spread across the roof downwardly commencing at approximately 10 to 12 inches from the baffle. Thus, the lower portion of the roof was washed by such a single sheet of zinc ion impregnated solution. This was most effective implementation of the invention because microbal or fungus growth normally commences at the lower portions of the roof and creeps upwardly with the least adverse growth in closer proximity to the roof ventilator 10.

Suitable rolled zinc sheets for forming the ventilator also are available in alloys for desirable strength. Modifications and variations in size and configuration of the ventilator and drain openings may occur to the skilled artisan without departing from the thrust of the invention as set forth in the claims.

I claim:

1. In a roof ridge ventilator adapted to be installed overlying the open ridge of and along the shingled roof of a building, said ventilator including a pair of flashing parts adapted to be anchored to the roof, and a pair of baffles each upstanding from the ends of one of the pair of flashing parts to which it is joined and spaced from the outer side walls of the ventilator, the improvement comprising forming said ventilator essentially of zinc sheet metal, and providing at the juncture between said baffles and said flashing parts, a series of drain openings in a straight line along the horizontal extent of each said baffle, wherein the number and size of said drain openings is sufficient that moisture passing through the drain openings from the space between the baffles and the outer side walls on each side of the ventilator will spread downwardly and diffuse outwardly, to form on the shingled roof a substantially uniform, single sheet of biostatic ionic zinc solution.

2. The ventilator of claim 1 in which each of said drain openings is approximately $\frac{3}{4}$ inches by $\frac{1}{4}$ inches and the openings are spaced apart on approximately 3 inch centers to achieve spacing between adjacent openings of approximately $2\frac{1}{4}$ inches.

3. The ventilator of claim 1 in which said single sheet of solution is formed in close proximity to the baffles.

4. The ventilator of claim 1 in which said single sheet of solution is formed approximately 10 to 12 inches from a baffle.

* * * * *